US007249567B1

(12) United States Patent
Wallin

(10) Patent No.: US 7,249,567 B1
(45) Date of Patent: Jul. 31, 2007

(54) SUBMARINE SHORT-RANGE DEFENSE SYSTEM

(75) Inventor: C. Roger Wallin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 319 days.

(21) Appl. No.: 11/015,804

(22) Filed: Dec. 20, 2004

(51) Int. Cl.
*B63G 8/30* (2006.01)
*B63G 3/04* (2006.01)

(52) U.S. Cl. ..... 114/319; 89/5

(58) Field of Classification Search ..... 89/5; 114/316, 318, 319, 320
See application file for complete search history.

(56) References Cited

U.S. PATENT DOCUMENTS 1,120,247 A * 12/1914 Schneider ..... 89/37.06
1,131,761 A * 3/1915 Wheaton ..... 114/316
1,349,414 A * 8/1920 Dougan ..... 89/1.701
2,349,009 A * 5/1944 Schwab ..... 114/320
5,677,506 A * 10/1997 Wallin ..... 89/38
5,911,172 A 6/1999 Korolenko
5,918,307 A 6/1999 Cipolla
6,408,763 B1 6/2002 Hurtta et al.

* cited by examiner

*Primary Examiner*—Stephen M. Johnson
(74) *Attorney, Agent, or Firm*—James M. Kasischke; Michael P. Stanley; Jean-Paul A. Nasser

(57) ABSTRACT

Disclosed is a launch system of an affixed lower section of launch tubing and an upper section of launch tubing configured to telescope vertically from a stowed position within the hull of a submarine to a position just above the ocean surface for a launch operation of a projectile, with the upper section returning to a stowed position after the launch operation. The launch system is capable of launching a projectile to engage air contacts by the discharge of high pressure fluid air, through the length of the upper and lower sections to impact the projectile for launch. The launch system includes surveillance, command and control elements as well as operational connection to additional projectile stowage and a supply of high pressure fluid. The projectile in use with the launch system can support surveillance and communications operations.

7 Claims, 6 Drawing Sheets

SUBMARINE SHORT-RANGE DEFENSE SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to submarines and more particularly to a launch system utilized with a submarine.

(2) Description of the Prior Art

Presently, modern submarines are designed to engage targets with devastating force. Submarine-launched torpedoes can seek and destroy other submarines and large surface ships at varying and long ranges. Furthermore, missiles fired from submarines can attack land targets hundreds of miles from the launch position of the missiles. Generally, both the offensive and defensive capabilities of submarines are formidable. However, shortfalls exist in the defensive capabilities of the submarine.

A submerged submarine is vulnerable to attack from directly above, particularly by airborne weapons launched at short range. If an enemy aircraft, or even a small surface craft, can establish its position over a submarine, there is no present defensive capability on the submarine to counter such a threat of attack. This vulnerability to attack is more present in that submarine operations often require that the submarine be brought to periscope depth; that is near but just below the surface. This vulnerability to attack is further present when a submarine is traveling on the surface, and when the submarine is moored at a pier in port.

One reason that a defensive vulnerability continues is that it is difficult to con FIG. a launch system that can successfully launch small defensive weapons, such as anti-air missiles, vertically, and in a simple manner, from a submerged submarine.

Proposed concepts for short-range defense of submarines have included mounting anti-aircraft weapons in the "sail" of a submarine, from which the weapons would be projected upward to the ocean surface. However, there are notable difficulties and disadvantages to such a proposed concept of defense. First, a substantial volume of space would be needed in the sail to accommodate a magazine for some number of weapons considered adequate for defense.

Second, missiles would have to be launched through a water column to the surface, before the missiles could function as airborne devices. While the missile-launching process is accomplished successfully when launching large tactical missiles from torpedo tubes and hull launchers, it would be difficult to launch small devices in the same manner of launch. This manner of launch requires large forces and complex mechanisms to deploy torpedo size missiles from traditional submarine launchers. It is therefore an engineering challenge to con FIG. a comparable capability for relatively small anti-aircraft weapons stored in the confined space that might be made available in the "sail" structure.

A third problem with sail-mounted launch systems is that sail mounted weapons would have to be specially made to endure the conditions of external underwater storage and/or ejection through the water to the surface.

As a result, a short range defensive weapon system for submarines is needed. It should be an objective of the launch system to store small anti-air weapons inside the hull of a submarine, and launch them into the air space above the submarine while the submarine remains submerged at periscope depth. It should also be an objective of the launch system to launch such weapons while the submarine is on the surface. The proposed system described in this disclosure would accomplish those objectives and would offer other significant features that are currently unavailable to submarines, such as deployment of anti-missile decoy countermeasures.

SUMMARY OF THE INVENTION

It is a therefore a general purpose and object of the present invention to provide the capability to store small anti-air weapons inside the hull of a submarine, and launch the anti-air weapons into the air space above the submarine while the submarine remains submerged at periscope depth.

It is a further object of the present invention to provide the capability to store small anti-air weapons inside the hull of a submarine, and launch the anti-air weapons into the air space above the submarine while the submarine is on the surface.

These objects are accomplished with the present invention by providing a launch system of an affixed lower section of launch tubing and an upper section of launch tubing con FIG. d for extension from a stowed position within the hull of a submarine to a position just above the ocean surface for a launch operation of a projectile, with the upper section returning to a stowed position after the launch operation. The launch system is capable of launching a projectile to engage air contacts by the discharge of high pressure fluid air, preferably high pressure air, through the length of the upper and lower sections to impact the projectile for launch. The launch system includes command and control elements as well as operational connection to additional projectile stowage and a supply of high pressure fluid air.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

The defense system embodied by the present invention adapts the principle of a "pneumatic gun" for launching a variety of small devices, including anti-air missiles, from within a submerged submarine into the air space above the submarine while the submarine remains at periscope depth. It is proposed that telescoping tubular sections be mounted in a vertical position in a submarine for the purpose of launching the devices.

Figure 1:
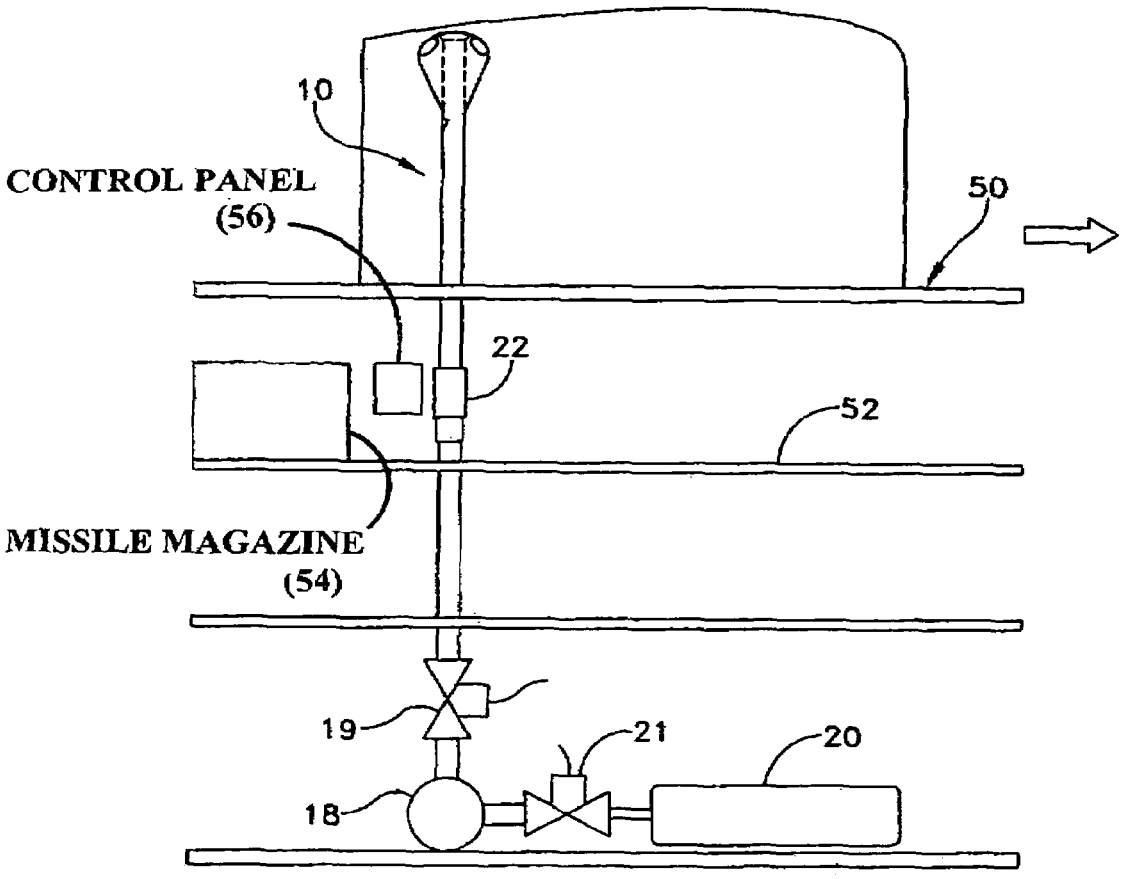
FIG. 1 shows a schematic of the launch system of the present invention located with a submarine.
Figure 2:
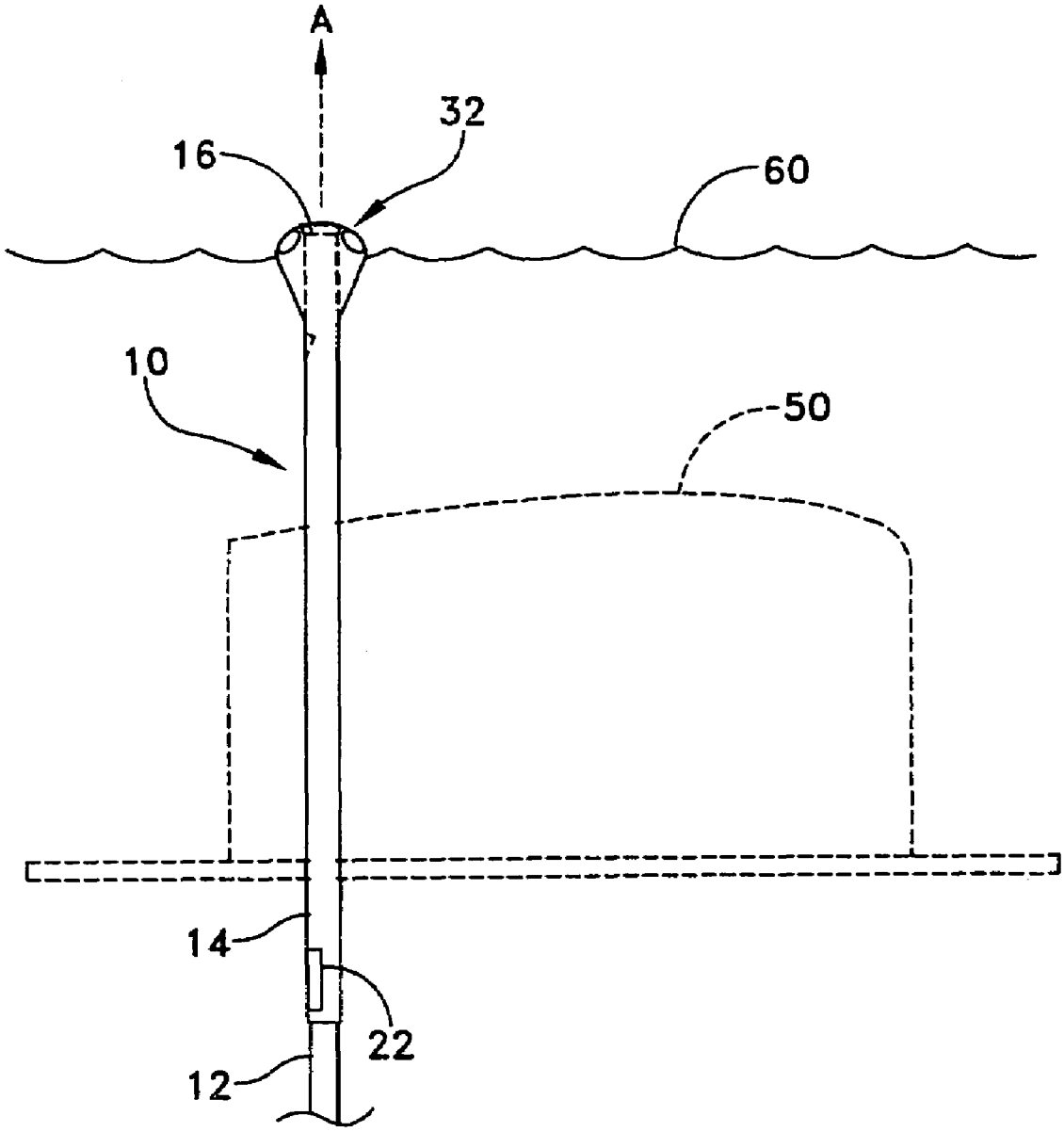
FIG. 2 shows a schematic of the launch system of the present invention in a launch position with a section of the launch system extended from the submarine.

The tubular sections would be comparable in size to that of a periscope, and would function similarly, in that the sections could be raised and lowered, extending an upper end to a position just above the ocean surface, and returning to a stowed position where the sections are housed within the hull and the "sail" of the vessel. The sections would constitute the barrel of a gun that is discharged by passing a charge of high pressure air through its length. FIGS. 1 and 2 illustrate the concept.

The launch system 10 shown in FIG. 1 of the present invention shown in FIG. 2 as generally composed of two sections, shown in FIG. 2. A lower section 12 is structurally affixed to a submarine 50 or similar vessel, while an upper section 14 is capable of telescoping, up and down from the lower section, so that an upper end 16 of the upper section can be extended in direction "A" to a surface 60 of the ocean when the submarine is at periscope depth. More specifically, the movable, upper section 14 as a launch tube, telescopes from the fixed, lower section 12 or launch tube, the upper section being of slightly larger diameter so as to surround the lower section, sliding against it in close contact.

The lower section 12 is fluidly connected to a pressurized flask 18 of air to provide a charge of air or similarly compressible fluid through the launch system 10 when a release valve 19 is actuated by an operator or by automated sequence. Preferably, the flask 18 is fluidly connected to a supply 20 of shipboard high pressure air or reservoir of pressurized fluid so that the flask can be recharged after each launch or else when otherwise needed by an operation of control valve 21.

Figure 3:
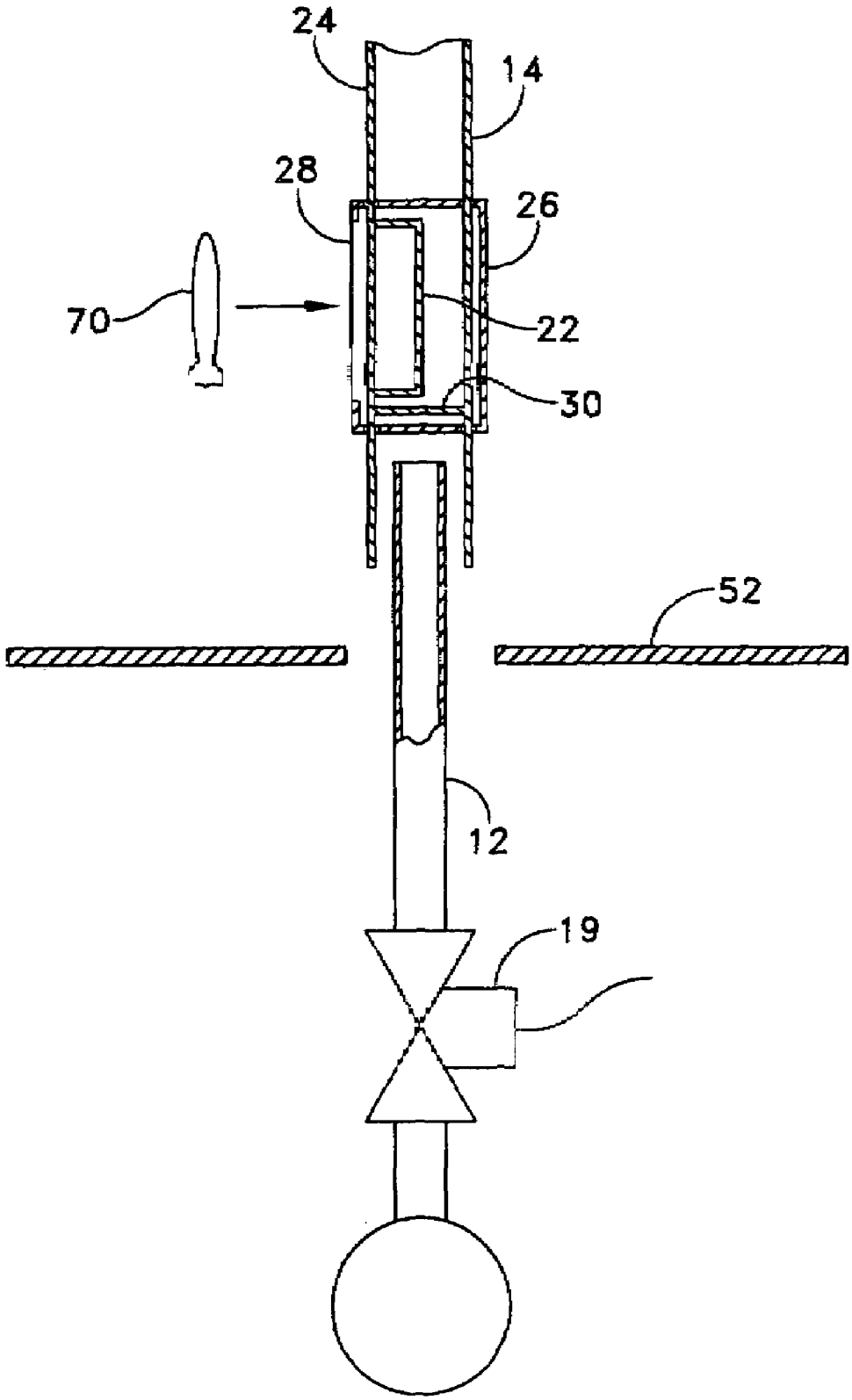
FIG. 3 shows a schematic of the launch system of the present invention with a projectile for use with the launch system depicted as part of the projectile loading sequence of the launch system.

For use in the submarine 50, the length of the fixed section 12 preferably terminates at a position a short distance above an upper platform deck 52 of the submarine. As shown in FIG. 3, when the movable, upper section 14 is raised to an extended position, the lower section 12 and upper section remain in telescoping contact by a short distance, typically about two to three feet.

Near a lower end of the upper section 14, a loading port 22 is provided as an aperture in the wall 24 of the upper section. The loading port 22 allows admission of projectiles 70 for projection through the launch system 10. When the upper section 14 is extended to the surface 60, the loading port 22 is positioned at a height above the upper platform deck 52 that will allow convenient access by shipboard personnel.

Surrounding the upper section 14 at the loading port 22 is a sleeve 26 that rotates about the upper section. An aperture 28 is provided in the sleeve 26 that is identical in size and shape to the loading port 22. When the sleeve 26 is turned so that the aperture 28 and the loading port 22 are aligned, access is provided to the interior of the upper section 14 for insertion of the projectile 70, such as a missile or other device intended for projection.

After the projectile 70 is loaded into the upper section 14, the sleeve 26 can be rotated so that the sleeve covers and closes the loading port 22. Preferably, a clamping fixture (not shown) secures the sleeve 26 in the closed position, thereby sealing the projectile 70 within the upper section 14.

When the projectile 70 is inserted into the upper section 14, it is rested on a grating 30 or other fitting that prevents the projectile from falling down the upper and lower sections, but allows acceptable passage of an air charge that is applied beneath the device to be launched.

Referring again to FIG. 1, a missile magazine 54 is located near the launch system 10 for ready and operational access to the projectiles 70 that are to be launched. The missile magazine 54 is shown on FIG. 1 to emphasize that the projectiles 70 launched by the launch system 10 are kept in a dry, benign environment, within the hull of the submarine 50, until intended for deployment. As such, the projectile 70 does not need to be hardened for outboard storage, and the projectiles do not need to be specially configured to endure transit through the ocean. This is a feature and advantage of the present invention.

FIG. 1 also depicts a control panel 56 as part of the launch system 10. The control panel 56 is operatively connected to raise and to lower the upper section 14, through mechanisms similar to that used for periscopes, and to operatively control pressurization of the air flask 18 and to operatively control the launch actuation release valve 19.

Control of the launch system 10 may be implemented as a stand alone capability, or it can be integrated with other systems that exist on the submarine 50. FIGS. 1 and 2 illustrate that at the upper end 16 of the upper section 14, a conical-shaped protrusion 32 surrounds the upper end or "muzzle" of the launch system 10.

Figure 4:
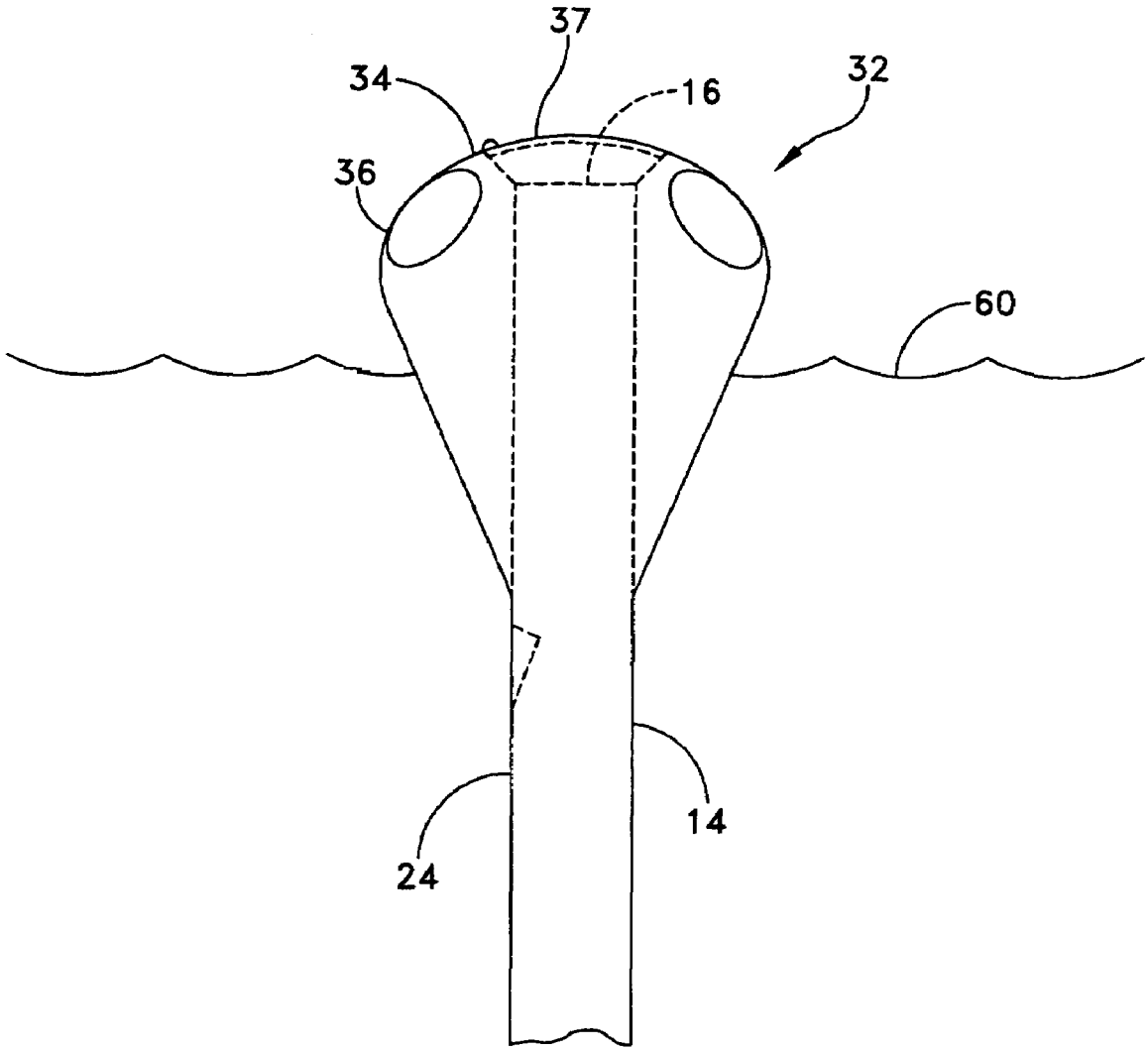
FIG. 4 shows a schematic with a protrusion of the launch system of the present invention conFIG. d with sensors projecting from an ocean surface.

As shown in FIG. 4, conical-shaped protrusion 32 houses the sensor part of the launch system 10. The conical-shaped protrusion 32 includes a domed surface 34 covered with photonic elements, similar to those used in advanced periscope technology. When the upper section 14 is extended to the surface 60, an array 36 of photonic elements, arranged about the end of the upper section, will be exposed to scan the air space above and around the submarine 50. The output signals from the array 36 are sent through conductors embedded in the launch system 10 and monitored within the submarine 50, preferably at independent equipment configured for control of the launch system or at consoles of the combat system of the submarine. If an object, such as an aircraft, is detected, a command decision will determine whether to engage the target by means of the projectile 70 (such as a short range weapon) launched from the launch system 10.

The exact shape and configuration of the photonic elements of the array 36 is a detail of implementation. However, it is envisioned that the upper end 16 of the upper section 14 would be surrounded by a structure that can accommodate target sensors and a mechanism for controlling a muzzle plug or cover 37 that will seal the launch system 10 from sea water entry. The muzzle cover 37 would serve to seal the upper section 14 in a manner similar to the "muzzle door" of a torpedo tube. Normally closed, the muzzle cover 37 would be designed to open momentarily during the process of launching the projectile 70 from the launch system 10, that action being timed and controlled by the control panel 56 or system firing circuit. Power to the muzzle cover 37 and to the array 36 at the upper end 16 is provided through conductors embedded in the wall 24 of the upper section 14.

Operation of the launch system 10 is described by the following typical sequence of events, where a hostile aircraft might be engaged using a small, heat-seeking missile. During normal operations of the submarine 50, the upper section 14 of the launch system 10 remains in its lowered, stowed position, the conical-shaped protrusion 32 and the array 36 being housed in the sail of the submarine, in a manner similar to that of other masts and devices located in the sail.

When "periscope depth" operations are anticipated, the launch system 10 is prepared for use. The flask 18 is charged with high pressure air, and an operator monitors sensor inputs at a remote display console. Another individual prepares the projectile 70, or other payload, for use.

The upper section 14 is extended to the surface and the system console operator monitors the air space above and around the submarine 50. The loading port 22 is now at a location above the upper platform deck 52, readily accessible for loading the projectile 70. If a hostile contact is observed in the vicinity, engagement may be ordered with the projectile 70.

If so, the projectile 70 is inserted into the upper section 14 through the loading port 22. The sleeve 26 is rotated and clamped to secure the projectile 70 within the upper section 14 and to ensure an air tight enclosure.

Upon initiation of the firing sequence, the muzzle cover 37 opens rapidly, immediately followed by actuation of the release valve 19 to release high pressure air or gas to the lower section 12 of the launch system 10.

The projectile 70 is discharged from the upper section 14 of the launch system 10. Near the open end of the upper section 14, a protruding "trigger-mechanism" on the inside wall strikes the projectile 70 as it passes. This "triggering" initiates the ignition process of the projectile 70, if the projectile is a missile, so that the projectile is able to continue in flight on its own power after it has been blown clear of the surface 60. The muzzle cover 37 then closes.

Within the submarine 50, the flask 18 is re-charged with high pressure air from the supply 20, by actuation of valve 21 to be ready for further use.

When periscope depth operations are concluded, the sealed upper section 14 is lowered and housed in its secured position.

Variations in operation of the launch system 10 occur when the launch system is used to launch projectiles other than anti-air missiles.

A major advantage and new feature of the proposed system is that it will enable a submarine 50, operating at periscope depth, to launch projectiles 70 in the air space above the submarine, without subjecting those projectiles to exposure or passage through water. That is, the projectiles 70 will launch as though being released from the surface 60, while the submarine 50 remains below the surface.

The launch system 10 facilitates introduction of a short range defensive capability against threat vehicles in the space above the submarine 50. In addition to small anti-aircraft missiles as the projectiles 70, the launch system 10 could be used to launch anti-missile countermeasures such as "chaff" that can confuse the targeting ability of an enemy missile that might attack the surfaced submarine 50.

Another major advantage and feature of the launch system 10 is that it can be used to deploy projectiles 70 not associated with short range defense capability. The launch system 10 is unique in that it will provide a multi-purpose launcher for small objects as the projectiles 70. In addition to defense related munitions, a variety of non-weapon type devices as the projectiles 70 could be ejected by the launch system 10. The projectiles 70 could include signals, buoys, antennas, or even limited quantities of disposable waste.

A significant advantage of the proposed system, relative to some other concepts that require a weapon magazine in the "sail" of the submarine 50, is that here there is no requirement for outboard stowage of projectiles to be launched by the launch system 10. Any projectile 70 intended to be launched by the launch system 10 will be kept dry, and in a non-threatening environment inside the submarine 50, until selected for deployment. Since the projectiles 70 projected from the submarine 50 by the launch system 10 exit the upper section 14 just above the surface 60, the projectiles need not be designed to withstand sea pressure, either when in stowage or during launch.

A further advantage of the launch system 10 is that the energy required to operate the launch system, i.e., high pressure air, is readily available on most submarines. The launch system 10 does not require any special kind of propellant or propulsion device. Operation of the launch system 10 does not produce any residual material or expended hardware. The launch system 10 can be re-set in a short time for repeated operation.

Finally, it should be recognized that the very existence of the proposed short range launch system 10 on a submarine will create the advantage of a valuable deterrent effect, since enemy aircraft will no longer be able to operate in the vicinity of submarines, assuming safety from attack.

The launch system 10 provides a defensive capability for submarines that might be subject to a threat, especially from the air, at close range. The launch system 10 addresses that threat for circumstances where the submarine 50 is submerged, at periscope depth, or where the submarine 50 is on the surface 60. While defense is the compelling reason to develop the launch system 10, the versatility of the launch system, described above, supports consideration of several alternative uses that would be of value.

Figure 5:
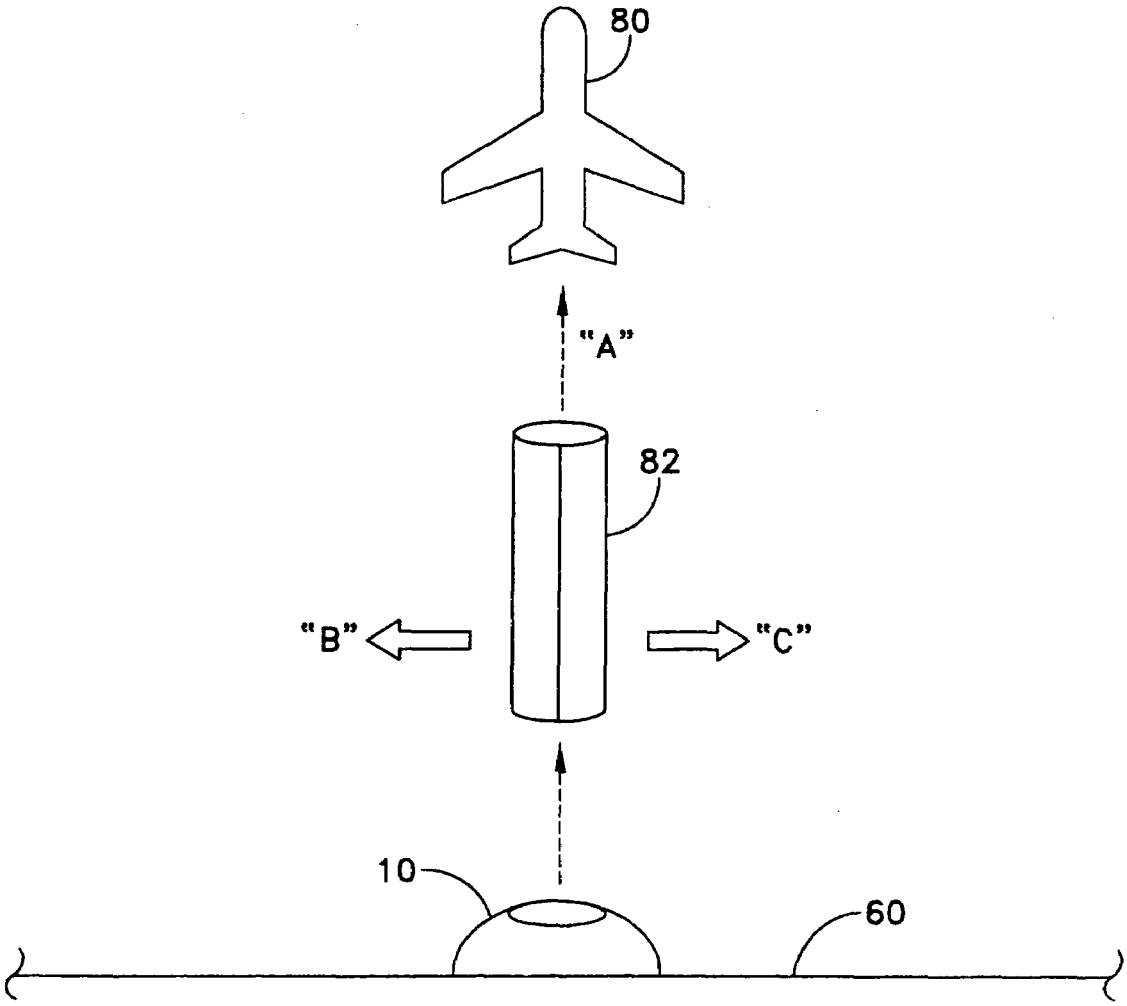
FIG. 5 shows a schematic of a small drone aircraft as a surveillance projectile from the launch system of the present invention.

An example of an alternative use of the launch system is shown in FIG. 5. A very small drone aircraft 80, capable of mounting a surveillance camera, is shown being launched in direction "A" from the launch system 10 as a canisterized assembly 82 that deploys after ejection by separation of the canisterized assembly in directions "A" and "C". It is suggested that images from such drone aircraft 80 could be transmitted to the submarine 50 that launched the drone aircraft, or to other forces equipped to receive the transmissions of the drone aircraft.

Figure 6:
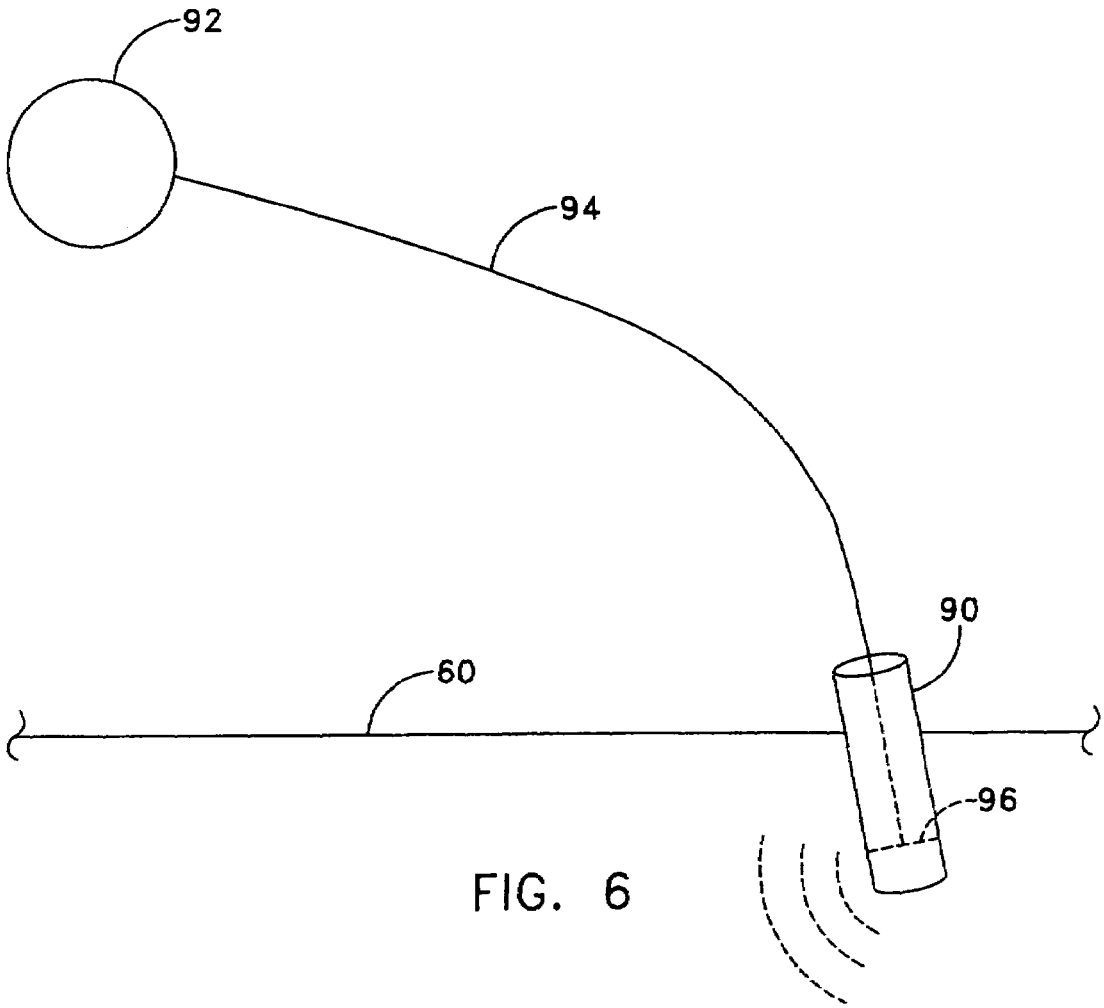
FIG. 6 shows a schematic of a canister with inflatable balloon as an alternative surveillance projectile for use with the launch system of the present invention.

Another alternative projectile for use is illustrated in FIG. 6. The projectile is a canister 90 that deploys a small helium balloon 92 after the walls of the canisterized assembly (similar to the canisterized assembly 82) separate following ejection from the launch system 10. The folded balloon 92 is inflated rapidly from a small helium flask (not shown) located in the canister 90. The balloon 92 supports a light weight antenna wire 94 that extends from a coiled configuration stowed beneath the balloon. A lower end of the antenna wire 94 is connected to a communications buoy 96 that occupies an end of the canister 90.

The antenna alternative of FIG. 6 may be considered as an independent electronic surveillance concept, or it may be combined with the alternative shown in FIG. 5 to support communication of information obtained by the drone aircraft 80.

There are other alternative devices that may be launched by the launch system 10. A common method of signaling an exercise event between a submarine and a surface ship or aircraft has been to deploy a dye marker that creates a pool of color in the ocean above the submarine. It is suggested that a pyrotechnic signal blown into the air is a visual method of communicating simple status reports. It would offer the advantage of being applicable to night-time operations as well as during daylight.

Alternatives also exist with respect to the implementation of the launch system 10. For example, if the launch system 10 is configured to launch an anti-missile countermeasure when the submarine 50 is surfaced, it is probable that radar will be incorporated as a system threat detection sensor. Integration of the launch system 10 with an existing combat system of the submarine 50 is preferred, but alternatively, the launch system 10 could also be produced as a stand-alone system.

Potential alternatives could also be recognized in the size and form of the components of the launch system 10. The launch system 10 described in this disclosure includes the upper section 14 as a launch tube that is very similar in size to that of a typical traditional optical periscope. Such an upper section or launch tube could support launch of a projectile that is about six or eight inches in diameter. Depending upon the projectiles 70, the drone aircraft 80 and the canister 90 selected for use in the fielded launch system 10, the size of the launch system can vary.

In light of the above, it is therefore understood that within the scope of the appended claims, the invention may be practiced otherwise than as specifically described.

What is claimed is:

1. A launch system for use with a submarine, said launch system comprising:

a tubular lower section;

a tubular upper section capable of telescoping from said lower section and an exterior hull of the submarine, said upper section sized to accommodate a projectile for a launch operation and comprising a loading port for an admission action of the projectile to said launch system;

a pressurized fluid storage fluidly connected to said lower section wherein said pressurized fluid storage is controllable to release a pressurized fluid that initiates the launch operation;

a supply of pressurized fluid fluidly connected to said pressurized fluid storage wherein said supply is controllable to recharge said pressurized fluid storage;

a sensor array positioned on an end of said upper section opposite an end of said upper section which telescopes from said lower section, said sensor array capable of signaling an initiation of the launch operation of said launch system; and a sleeve encompassing a periphery of said upper section wherein said sleeve permits a closing action of said loading port and the admission action to said loading port;

wherein the launch operation of the projectile from said launch system, said upper section telescopes to the exterior of the submarine thereby allowing the projectile to launch through said upper section at a distance of the telescoping action from the exterior of the submarine.

2. The launch system in accordance with claim 1 further comprising a magazine capable of storing a plurality of the projectiles, said magazine operationally connected to said upper section.

3. A launch system for use with a submarine, said launch system comprising:

a tubular lower section;

a tubular upper section capable of telescoping from said lower section and an exterior hull of the submarine, said upper section sized to accommodate a projectile for a launch operation and comprising a loading port for an admission action of the projectile to said launch system;

a pressurized fluid storage fluidly connected to said lower section wherein said pressurized fluid storage is controllable to release a pressurized fluid that initiates the launch operation;

a supply of pressurized fluid fluidly connected to said pressurized fluid storage wherein said supply is controllable to recharge said pressurized fluid storage; and a sleeve encompassing a periphery of said upper section wherein said sleeve permits a closing action of said loading port and the admission action to said loading port;

wherein the launch operation of the projectile from said launch system, said upper section telescopes to the exterior of the submarine thereby allowing the projectile to launch through said upper section at a distance of the telescoping action from the exterior of the submarine.

4. The launch system in accordance with claim 3 further comprising a magazine capable of storing a plurality of the projectiles, said magazine operationally connected to said upper section.

5. A system for a communication operation with a submarine, said system comprising:

a launch apparatus including a tubular lower section and a tubular upper section capable of telescoping from said lower section and an exterior hull of a submarine, wherein during a launch operation said upper section telescopes to the exterior of the submarine at a distance of the telescoping action from the exterior of the submarine;

a canister positioned within said launch apparatus;

a balloon stored within said canister, said balloon deployable after the launch operation of said canister from said launch apparatus by separation of said canister; and a buoy stored within said canister and tethered by antenna wire to said balloon, said buoy deployable after the launch operation of said canister from said launch apparatus by the separation of said canister wherein a combination of said buoy and said antenna are capable of the communication operation to the submarine.

6. The system in accordance with claim 5 further comprising a pressurized fluid storage fluidly connected to said lower section of said launch apparatus wherein said pressurized fluid storage is controllable to release a pressurized fluid that initiates the launch operation.

7. The surveillance system in accordance with claim 6 wherein said upper section further comprises a loading port for an admission action of said canister to said launch apparatus.

* * * * *